US010480754B2

(12) United States Patent
Gomi et al.

(10) Patent No.: US 10,480,754 B2
(45) Date of Patent: Nov. 19, 2019

(54) ILLUMINATION DEVICE

(71) Applicant: NICHIA CORPORATION, Anan-shi, Tokushima (JP)

(72) Inventors: Keiichi Gomi, Chino (JP); Takanori Aruga, Suwa-gun (JP)

(73) Assignee: NICHIA CORPORATION, Anan-Shi (JP)

( * ) Notice: Subject to any disclaimer, the term of this patent is extended or adjusted under 35 U.S.C. 154(b) by 162 days.

(21) Appl. No.: 15/854,542

(22) Filed: Dec. 26, 2017

(65) Prior Publication Data

US 2018/0180254 A1 Jun. 28, 2018

(30) Foreign Application Priority Data

Dec. 27, 2016 (JP) ..... 2016-254245

(51) Int. Cl.

| | |
|---|---|
| ***F21V 13/14*** | (2006.01) |
| ***F21V 7/00*** | (2006.01) |
| ***F21V 7/26*** | (2018.01) |
| ***F21V 17/02*** | (2006.01) |
| ***F21S 6/00*** | (2006.01) |

(Continued)

(52) U.S. Cl.

CPC ..... *F21V 13/14* (2013.01); *F21S 6/00* (2013.01); *F21V 7/0016* (2013.01); *F21V 7/0033* (2013.01); *F21V 7/0091* (2013.01); *F21V 7/26* (2018.02); *F21V 9/30* (2018.02); *F21V 17/02* (2013.01); *F21V 21/30* (2013.01); *F21Y 2115/30* (2016.08)

(58) Field of Classification Search

CPC ... F21V 13/14; F21V 9/30; F21V 7/26; F21V 7/0016; F21V 7/0033; F21V 7/0091; F21V 17/02; F21V 21/30; F21S 6/00

See application file for complete search history.

(56) References Cited

U.S. PATENT DOCUMENTS 4,388,678 A * 6/1983 Turner ..... F21S 6/005 362/127
2013/0329442 A1* 12/2013 Kishimoto ..... C09K 11/7774 362/510

(Continued)

FOREIGN PATENT DOCUMENTS

| | | |
|---|---|---|
| JP | 2004-296311 A | 10/2004 |
| JP | 2014-093191 A | 5/2014 |
| JP | 2016-051617 A | 4/2016 |

*Primary Examiner* — Jong-Suk (James) Lee
*Assistant Examiner* — Christopher E Dunay
(74) *Attorney, Agent, or Firm* — Foley & Lardner LLP

(57) ABSTRACT

An illumination device includes: a laser light source; a cylindrical body disposed such that light emitted from the laser light source enters the cylindrical body at a first end portion side of the cylindrical body and passes through the cylindrical body; a reflector disposed so as to reflect light passing through the cylindrical body; and a ring assembly comprising a ring-shaped inner circumferential surface configured to reflect and propagate light from the reflector. The reflector includes: a first reflecting surface configured to reflect a first portion of light emitted from the laser light source, and a second reflecting surface configured to reflect a second portion of light emitted from the laser light source. The ring assembly further includes a fluorescent surface adapted to emit fluorescence by light reflected and propagated at the inner circumferential surface.

18 Claims, 6 Drawing Sheets

(51) Int. Cl.

| | |
|---|---|
| ***F21V 21/30*** | (2006.01) |
| ***F21V 9/30*** | (2018.01) |
| *F21Y 115/30* | (2016.01) |

(56) References Cited

U.S. PATENT DOCUMENTS

| | | | | |
|---|---|---|---|---|
| 2015/0070897 | A1* | 3/2015 | Chien | F21V 29/20 362/269 |
| 2016/0320050 | A1* | 11/2016 | Barnhart | F21L 4/02 |
| 2017/0166119 | A1* | 6/2017 | Lee | B60Q 3/14 |
| 2018/0274742 | A1* | 9/2018 | Zhang | F21S 8/024 |
| 2019/0078758 | A1* | 3/2019 | Haigh | F21V 5/046 |

* cited by examiner

ILLUMINATION DEVICE

CROSS-REFERENCE TO RELATED APPLICATION

This application claims priority to Japanese Patent Application No. 2016-254245, filed on Dec. 27, 2016, the disclosure of which is hereby incorporated by reference in its entirety.

BACKGROUND

1. Technical Field

The present disclosure relates to an illumination device using a laser light beam.

2. Description of Related Art

In recent years, an illumination device using a laser diode (LD) for a light source has been developed.

For example, JP 2014-093191 A proposes a solid illumination device in which light emitted from a laser diode in a light source at a lower side is reflected upward by a mirror, and emitted in a predetermined direction. JP 2016-051617 A proposes an illumination device in which a light beam emitted from a laser light source is incident on a circular ring, and is reflected at the inner circumferential surface of the ring, and diffused, and the diffused light is used for illumination light.

SUMMARY

In the illumination device proposed in JP 2014-093191, a region where light is wavelength-converted into illumination light through a light conversion member is relatively small, and thus there is room for further improvement. The illumination device in JP 2016-051617 A has room for further improvement in order to be an illumination device having good practicality.

The concepts described in this disclosure have been made in view of the circumstances described above, and one object of certain embodiments is to provide a practical illumination device that has a small size and a simple structure, and can emit ring-shaped illumination light having a uniform luminous intensity.

An illumination device according to one embodiment includes: a laser light source; a cylindrical body disposed so that light emitted from the laser light source enters the cylindrical body at a first end portion side of the cylindrical body and passes through the cylindrical body; a reflector disposed so as to reflect light passing through the cylindrical body; and a ring assembly including a ring-shaped inner circumferential surface that reflects and propagates light from the reflector. The reflector includes: a first reflecting surface that reflects a first portion of light emitted from the laser light source so that the portion of light is propagated from a first side of the inner circumferential surface in the circumferential direction to a second side of the inner circumferential surface in the circumferential direction, and a second reflecting surface that reflects a second portion of light emitted from the laser light source so that the second portion of light is propagated from the second side of the inner circumferential surface in the circumferential direction to the first side of the inner circumferential surface in the circumferential direction. The ring assembly further includes a fluorescent surface adapted to emit fluorescence by light reflected and propagated at the inner circumferential surface.

In the illumination device according certain embodiments of the present disclosure, a light beam can be reflected at the inner circumferential surface of a ring assembly by a reflector and propagated, and a portion of the reflected light beam can be converted into illumination light and emitted to outside. Accordingly, with a small-sized and simple configuration including a laser light source and a ring, ring-shaped illumination light having a uniform luminous intensity can be obtained.

DETAILED DESCRIPTION OF EMBODIMENTS

Figure 1:
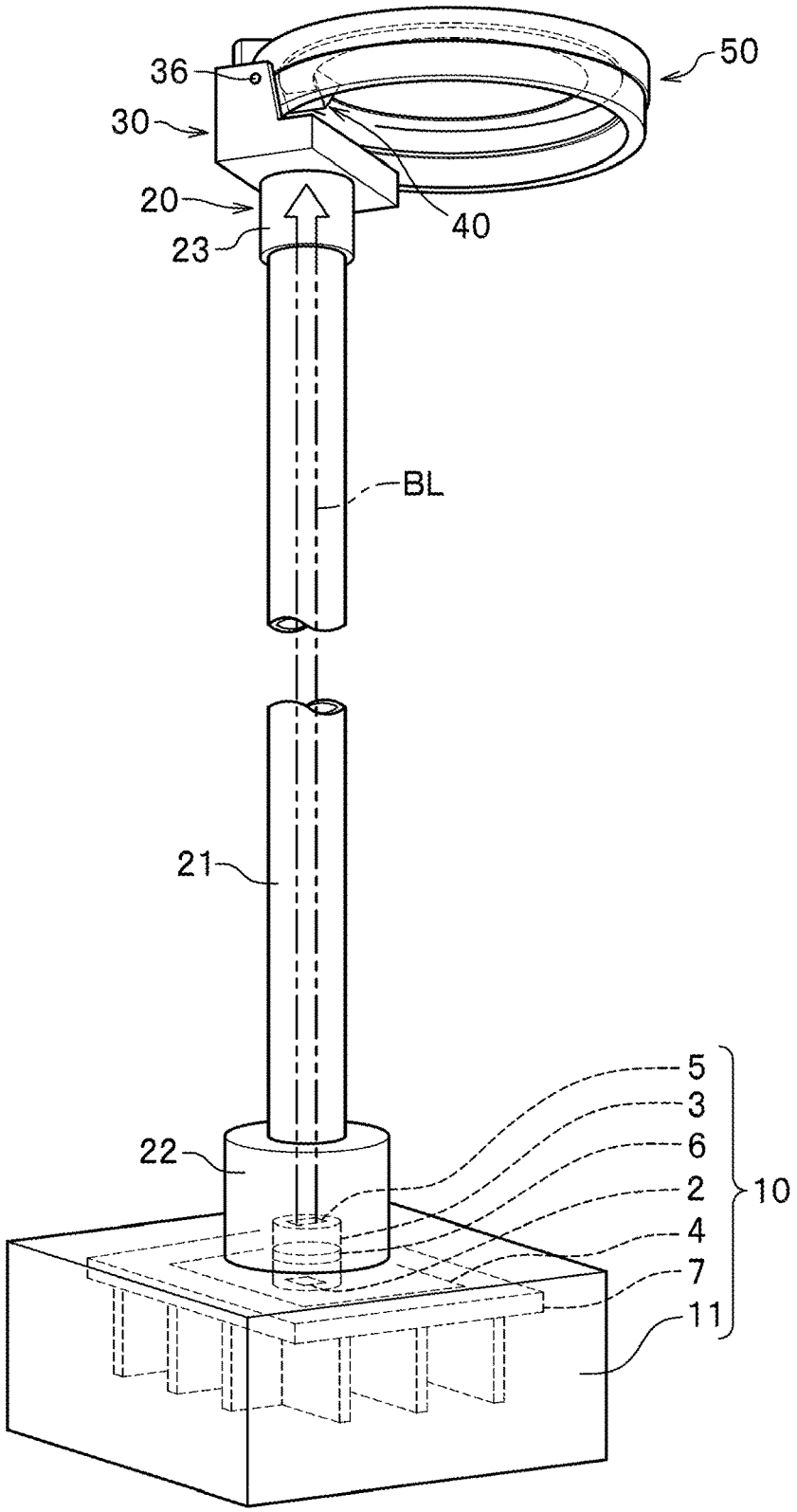
FIG. 1 is a perspective view schematically showing a configuration of an illumination device according to one embodiment of the present invention in which illustration of a portion of the illumination device is omitted.

Hereinafter, certain embodiments of the present invention will be described with reference to the drawings. The embodiment shown below is intended as illustrative of an illumination device to give a concrete form to the technical idea of the present invention, and the present invention is not limited to the description below. The drawings referred to hereinafter are intended to schematically show embodiments of the present invention, and therefore scales, intervals, positional relationships, etc., of the members may be exaggerated, or illustrations of some of the members may be omitted. In the description below, the same designations and the same reference numerals denote the same or like members in general, and duplicated descriptions thereof may be omitted as necessary.

An illumination device 1 includes a laser light source 10, a cylindrical body 20 connected to the laser light source 10, a ring assembly 50 supported on the cylindrical body 20 via a holding body 30 disposed therebetween, and a reflector 40 supported on the ring assembly 50 and disposed opposite to an optical path of laser light.

In the illumination device 1, light (laser light or light beam) BL emitted from the laser light source 10 passes through the cylindrical body 20 and is struck on the reflector 40, so that the light is split and a direction of an optical path of the light is changed to propagate along an inner circumferential surface (light reflecting surface 52*a*) of the ring assembly 50. In the illumination device 1, a portion of laser light is wavelength-converted while propagating along the inner circumferential surface of the ring assembly 50, which allows for obtaining illumination light, and the illumination light is emitted, herein, in a direction facing a fluorescent surface 53. The term "light beam" is synonymous with the term "laser light BL", and can interchangeably be expressed as "laser light BL". Configurations of the illumination device 1 will be described below.

As shown in FIG. 1, the laser light source 10 is configured to emit laser light BL to the ring assembly 50. The laser light source 10 includes, for example, a laser diode 2, a stem columnar body 3 storing the laser diode 2, a substrate 4 supporting the stem columnar body 3 and on which the laser diode 2 is mounted, and a housing 11 storing the stem columnar body 3 and the substrate 4.

In the laser light source 10, a collimating lens 6 is disposed at a position facing the laser diode 2 in the stem columnar body 3, which allows for emitting laser light BL in which a cross-sectional shape of the laser light BL is adjusted. The collimating lens 6 may be a single lens or a compound lens, and any appropriate lens may be used for collimating lens 6 as long as it can converge laser light BL and convert the laser light BL into parallel light. The collimating lens 6 is made of, for example, quartz glass, sapphire glass, borosilicate glass or a resin. The stem columnar body 3 has an opening such as a slit hole 5 for transmitting laser light BL to the cylindrical body 20.

The laser light source 10 includes a heat sink 7 for releasing heat to the substrate 4. The cylindrical body 20 is connected to the housing 11 of the laser light source 10 so as to face a through-hole of the housing 11 through which laser light is transmitted.

The cylindrical body 20 transmits laser light from the laser light source 10 to a ring assembly 50 side without exposing the laser light to outside, and supports the ring assembly 50 so that the ring assembly 50 is located at a predetermined height. In the cylindrical body 20, a first end portion of a hollow pipe 21 is connected to the housing 11 of the laser light source 10 via a first interposing pipe 22, and a second end portion of the hollow pipe 21 is connected to the holding body 30 via a second interposing pipe 23. Each of the first interposing pipe 22 and the second interposing pipe 23 is a circular cylinder-shaped pipe having an outer diameter larger than that of the hollow pipe 21. The hollow pipe 21 is a circular cylinder-shaped pipe in which a first end and a second end thereof is open. The cylindrical body 20 is preferably made of, for example, a resin that is less easily degraded by laser light, glass, or metal, and formed so that laser light is not seen from outside. The cylindrical body 20 has an inner diameter greater than the diameter of laser light BL, within which the hollow pipe 21 is disposed. The cylindrical body 20 has a predetermined length.

The holding body 30 is supported by the cylindrical body 20, and supports the ring assembly 50. The holding body 30 has a structure that allows a support angle, at which the ring assembly 50 is supported, of the holding body 30 to be adjusted. The holding body 30 includes a pedestal 31 connected to the second end of the cylindrical body 20, and a rotary support shaft 36 attached to the pedestal 31 to support the ring assembly 50 so that the position of the ring assembly 50 can be adjusted to be a predetermined angle.

The pedestal 31 includes a main body portion 32 having a rectangular solid shape, and upward-extending portions 33 disposed at both ends of the main body portion 32 in the longitudinal direction. The pedestal 31 is made of a resin or a metal.

The main body portion 32 has a rectangular shape in plan view. At a central portion of the main body portion 32A, through-hole 34 extending in a thickness direction of the main body portion 32A is formed so as to face a first end portion of the cylindrical body 20. The upward-extending portions 33 are disposed to face each other at both end portions of the main body portion 32 in the longer direction, and extend perpendicularly upward. For example, in a side view, each of the upward-extending portions 33 has a substantially trapezoidal shape in which a width at a main body portion 32 side is increased. Each of the upward-extending portions 33 is disposed at a position inward from a first end portion (i.e., a front side) of the main body portion 32 in the lateral direction thereof. In each of the upward-extending portions 33, a shaft hole 35 for supporting the rotary support shaft portion 36 is formed in a thickness direction thereof. Each of the upward-extending portions 33 has a diameter of the shaft hole 35 and a thickness that allow the rotary support shaft portion 36 to be in a friction state in which the rotary support shaft portion 36 can support the ring assembly 50 at a predetermined angle when the rotary support shaft portion 36 is supported by the shaft hole 35. Each of the upward-extending portions 33 is disposed spaced apart from a first end portion of the main body portion 32 in the lateral direction (i.e., a front side), so that a range of an angle at which the ring assembly 50 can be moved can be increased when the ring assembly 50 is moved to a predetermined angle.

The rotary support shaft portion 36 is supported at both ends thereof by the shaft hole 35 of each of the upward-extending portions 33, and supports the ring assembly 50. With the rotary support shaft portion 36, the angle of the ring assembly 50 can be adjusted. The rotary support shaft portion 36 is made of, for example, a metal bar, which forms the shaft center, and a resin surrounding the metal bar. The rotary support shaft portion 36 is supported by the shaft hole 35 such that the static friction coefficient is greater than the dynamic friction coefficient. Thus, when an operator moves the ring assembly 50 by hand fingers to change the angle of the ring assembly 50, the rotary support portion 36 rotates by a predetermined angle against the fastening force applied by the operator, and thus is supported at a position corresponding to the angle at which the ring assembly 50 is moved by the operator. The rotary support shaft portion 36 is disposed such that the shaft center of the rotary support shaft portion 36 corresponds to the central portion of the reflector 40 supported by the ring assembly 50 (see FIGS. 5, 9A and 9B). Thus, even when the support angle of the ring assembly 50 is changed, the laser light source 10 can emit laser light BL to an appropriate portion of the reflector 40. The holding body 30 is formed so that the reflector 40 can always appropriately reflect laser light BL to the light reflecting surface 52*a* of the ring assembly 50.

Figure 2:
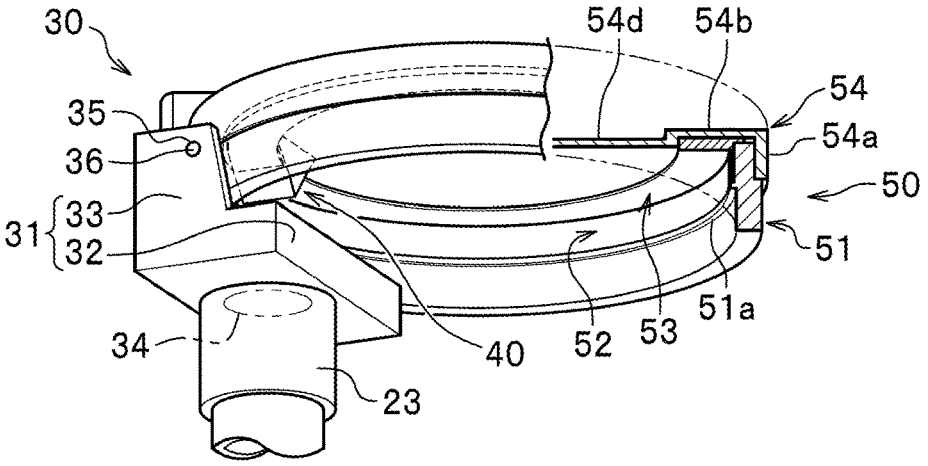
FIG. 2 is a perspective view schematically showing the illumination device according to one embodiment of the present invention in which illustration of a portion of a ring assembly of the illumination device is omitted and a cross-sectional view of a part of the ring assembly is shown.
Figure 3:
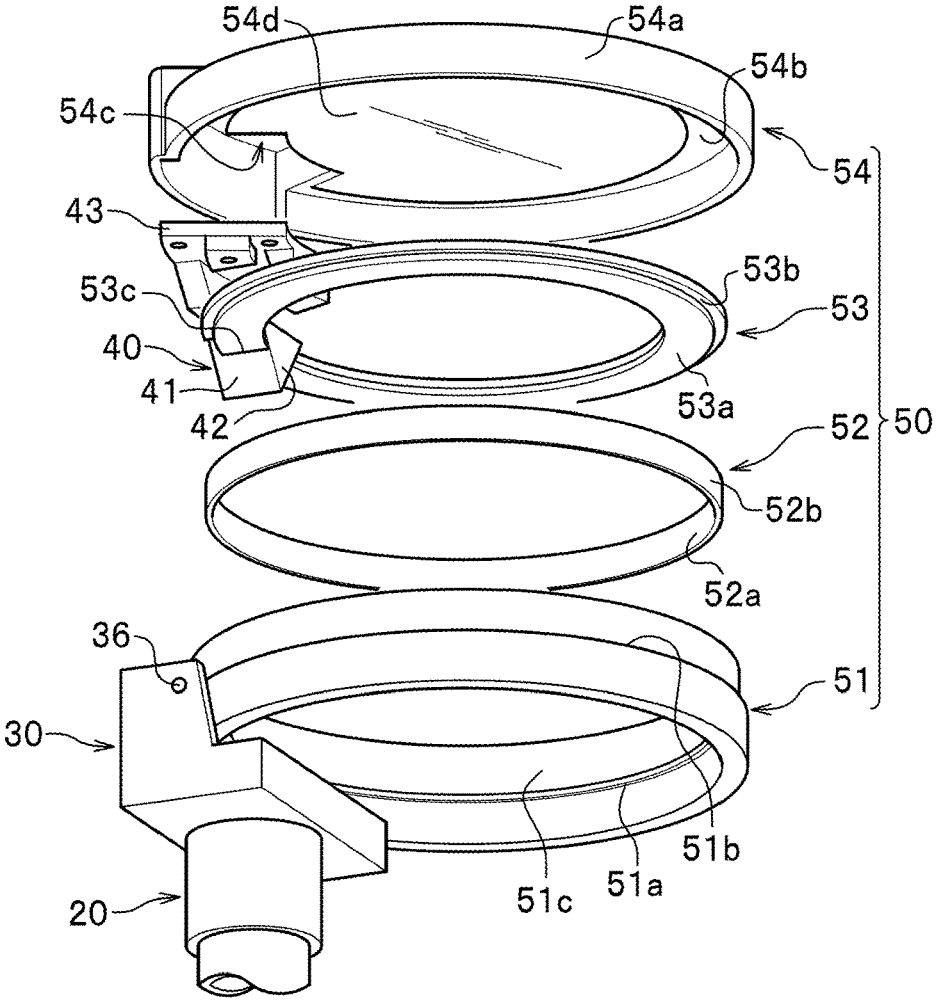
FIG. 3 is an exploded perspective view schematically showing a ring of the illumination device according to one embodiment of the present invention.
Figure 5:
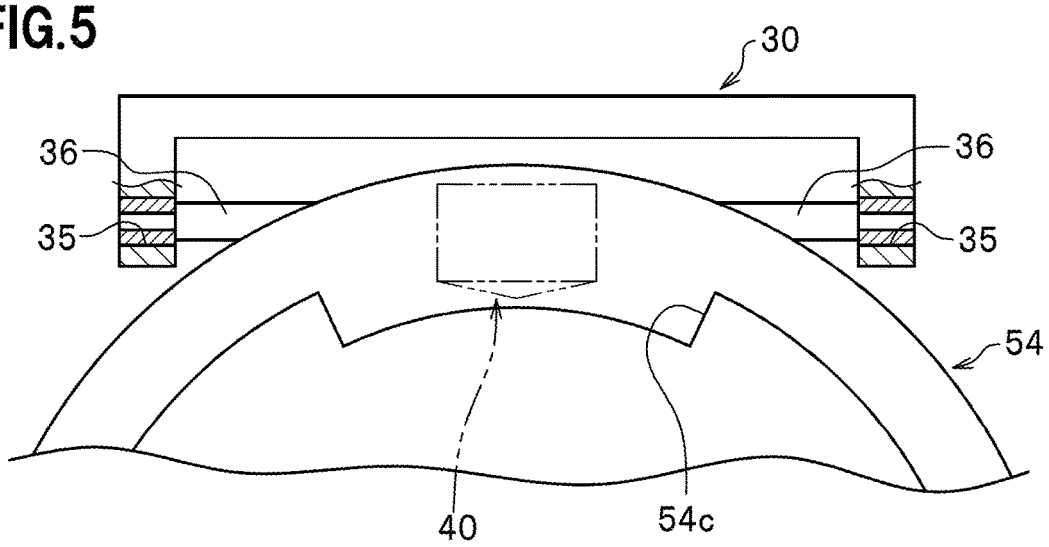
FIG. 5 is a plan view showing a relationship between the ring assembly and a holding body in the illumination device according to one embodiment of the present invention in which illustration of a portion of the ring assembly and a portion of a holding body is omitted and a cross-sectional view of a portion of the holding body is shown.

As shown in FIGS. 2, 3 and 5, laser light BL emitted from the laser light source 10 is incident on the ring assembly 50 and is propagated in the circumferential surface (i.e., light reflecting surface 52*a*) of the ring assembly 50, while a portion of the laser light BL is converted into illumination light and is emitted. As described above, the ring assembly 50 is held by the holding body 30, and is attached to the cylindrical body 20. The rotary support shaft portion 36 is fixed to the ring assembly 50. The ring assembly 50 is held on the pedestal 31 at a predetermined angle in a rotatable manner via the rotary support shaft portion 36 of the holding body 30. The ring assembly 50 includes a base ring 51, a reflecting ring 52 on the inner circumferential surface of the base ring 51, an upper surface ring 53 supported by the base ring 51 such that a surface of the upper surface ring 53 is disposed perpendicular to the inner circumferential surface of the reflecting ring 52, and a cover (i.e., light shielding member) 54 supported by the base ring 51 and covers the base ring 51. The ring assembly 50 described here has a configuration in which laser light BL from the reflector 40 is reflected by the light reflecting surface 52*a* of the reflecting ring 52, which is detachable from the base ring 51, and propagated, as one example.

The base ring 51 is fixed at a first end side thereof by the rotary support shaft portion 36, and supports the reflecting ring 52, the upper surface ring 53 and the cover 54. The base ring 51 has a circular ring shape, and includes an engaging protrusion portion 51*a* located on an inner circumferential side, and a step portion 51*b* located on an outer circumferential side. The base ring 51 includes an inner circumferential surface 51*c* located above the engaging protrusion portion 51*a* and having a diameter that allows the inner circumferential surface 51*c* to face and fit with an outer circumferential surface 52*b* of the reflecting ring 52.

The inner circumferential surface 51*c* of the base ring 51 can be engaged with the reflecting ring 52 and a portion of the upper surface ring 53.

More specifically, the inner circumferential surface 51*c* of the base ring 51 has a height between the engaging protrusion portion 51*a* and the upper end of the base ring 51 equal to the sum of a total height of the reflecting ring 52 and a height of a part of the upper surface ring 53. The base ring 51 includes an outer circumferential surface located above the step portion 51*b* and having a diameter that allows the outer circumferential surface of the base ring 51 to face and fit with an inner circumferential surface of the cover 54.

In the base ring 51, a length between the engaging protrusion portion 51*a* and a lower end of the base ring 51 and a length between the step portion 51*b* and the lower end of the base ring 51 are respectively equal to, for example, a length between the engaging protrusion portion 51*a* and an upper end of the base ring 51. With this arrangement, laser light BL from the reflector 40 is hardly leaked to outside.

As shown in FIGS. 2, 3, 6 and 8, the reflecting ring 52 attached to the base ring 51 has a structure in which the inner circumferential surface of the reflecting ring 52 serves as the light reflecting surface 52*a*. The light reflecting surface 52*a* has a width equal to or greater than a diameter of laser light BL. The reflecting ring 52 is engaged with the base ring 51 such that a lower end portion of the reflecting ring 52 abuts the engaging protrusion portion 51*a* of the base ring 51. In the reflecting ring 52, the light reflecting surface 52*a* is formed by performing mirror-polishing, or by attaching a material serving as a mirror surface. Examples of a material of the light reflecting surface 52*a* includes aluminum, tin, silver, zinc, magnesium, and platinum.

Laser light BL that has been reflected by the first reflecting surface 41 or the second reflecting surface 42 of the reflector 40 is repeatedly reflected at the light reflecting surface 52*a* in a circumferential direction thereof, which allows laser light BL to be reflected and propagated in the base ring 51 in a circumferential direction thereof.

The light reflecting surface 52*a* has a width that allows mirror-reflected components of laser light BL to go round the reflecting ring 52 at least once. More specifically, the light reflecting surface 52*a* has a width that allows, in view of the diameter of laser light BL, laser light BL to be reflected and propagated so as to go around from the first reflecting surface 41 to the second reflecting surface 42 side, or from the second reflecting surface 42 to the first reflecting surface 41 side. Laser light BL that has been reflected by the first reflecting surface 41 is propagated such that the optical axis of the propagated laser light BL is located at an upper side with respect to the center of the light reflecting surface 52*a* in the width direction, at a first end or a second end of the light reflecting surface 52*a* in the circumferential direction (see FIGS. 7A and 7B). Thus, on the light reflecting surface 52*a*, laser light BL is helically propagated obliquely upward with respect to the light reflecting surface 52*a* so that the laser light BL can be propagated to go round the light reflecting surface 52*a*.

The upper surface ring 53 is disposed adjacent to the reflecting ring 52 so as to form a predetermined angle (e.g. right angle) with respect to the light reflecting surface 52*a* of the reflecting ring 52 via the base ring 51 disposed between the upper surface ring 53 and the reflecting ring 52. The upper surface ring 53 includes an abutting end portion 53*b* abutting an upper end surface of the base ring 51, and a fluorescent surface 53*a* connected with the abutting end portion 53*b* via a step and located at an inner diameter side with respect to the light reflecting surface 52*a* of the reflecting ring 52. In the upper surface ring 53, a fluorescent material, which serves as a light conversion member, is disposed at the fluorescent surface 53*a*, and a portion of laser light BL reflected by the light reflecting surface 52*a* of the reflecting ring 52 is wavelength-converted by the fluorescent material into light having a different wavelength.

In the upper surface ring 53, for example, in the case where a blue-light emitting laser diode 2 is used, using a yellow-emitting fluorescent material for the wavelength conversion member allows for obtaining white illumination light. The fluorescent surface 53*a* of the upper surface ring 53 has a width that allows a portion of a light beam diffused from the light reflecting surface 52*a* to be incident on the fluorescent surface 53*a*. The upper surface ring 53 has a gap 53*c* in which the reflector 40 is protruded. The gap 53*c* of the upper surface ring 53 has such a size that allows a portion or the entirety of the reflector 40 to be exposed. In the upper surface ring 53, a portion of laser light BL reflected by the reflecting ring 52 enters the upper surface ring 53, and the laser light BL is wavelength-converted, which allows the upper surface ring 53 to emit light, so that ring-shaped illumination light can be obtained.

Figure 4:
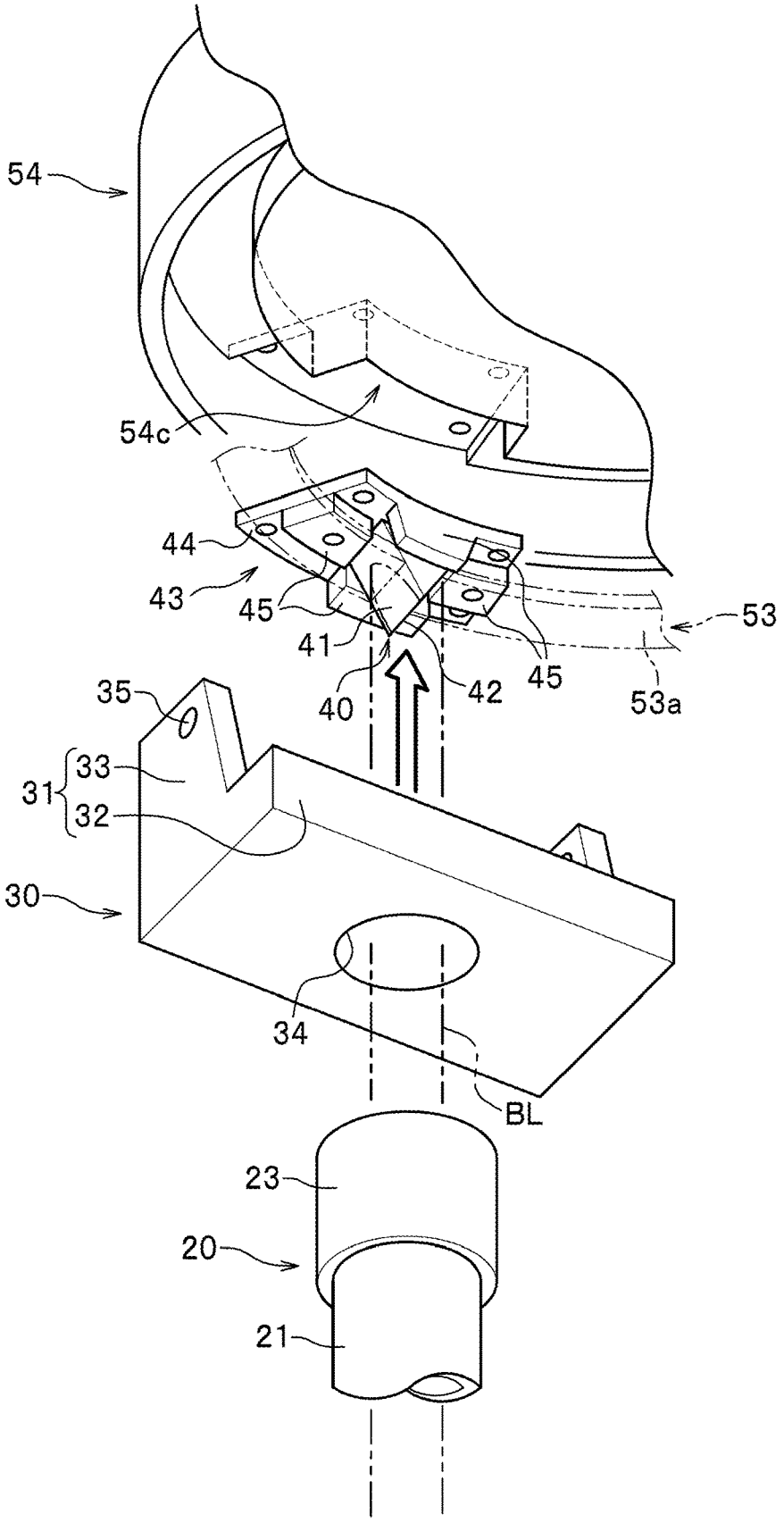
FIG. 4 is an exploded perspective view schematically showing a configuration of a reflector and a support member of the illumination device according to one embodiment of the present invention in which illustration of a portion of the illumination device is omitted.

As shown in FIGS. 2 to 4, the cover 54 is a light shielding member that shields light from the laser light source 10, light from the reflecting ring 52 and light from the upper surface ring 53. The cover 54 has a cap shape that is open at a first end thereof and closed at a second end thereof. The cover 54 includes a lateral circumferential portion 54*a* having a first end portion at an opening side, a top plate inner circumferential surface 54*b* having a circular ring shape extending perpendicularly from a second end portion of the lateral circumferential portion 54*a* toward the inner diameter side, an attachment recess 54*c* for attaching a support member 43, the attachment recess 54*c* formed in a portion of the top plate inner circumferential surface 54*b*, and a central top plate 54*d* covering the top plate inner circumferential surface 54*b* at the inner diameter side.

The lateral circumferential portion 54*a* has an inner diameter corresponding to the outer circumferential diameter of the base ring 51, and a first end portion of the lateral circumferential portion 54*a* abuts the step portion 51*b* of the base ring 51.

The top plate inner circumferential surface 54*b* is continuous with the second end portion of the lateral circumferential member 54*a*, and has a width that allows the top plate inner circumferential surface 54*b* abuts the upper surface ring 53 and covers the upper surface ring 53. The top plate inner circumferential surface 54*b* is formed continuously and integrally with the central top plate 54*d*, may be made of a material different from the central top plate 54*d* so as to be separate from the central top plate 54*d*.

The central top plate 54*d* is formed so as to extend from the top plate inner circumferential surface 54*b* through the step. The central top plate 54*d* is disposed at such a position that allows for closing the space in the upper surface ring 53 at the inner diameter side. In the central top plate 54*d*, for example, a reflecting member is applied or bonded to the inner lateral surface thereof, which allows light to be reflected downward, so that light extraction efficiency of illumination light can be improved.

In the attachment recess 54*c*, the support member 43 that supports reflector 40 is disposed. The attachment recess 54*c* is a recess formed toward a side away from the upper surface ring 53 side in a portion of the top plate inner circumferential surface 54*b* having a predetermined area in the circumferential direction. The attachment recess 54*c* is formed such that the reflector 40 supported on the support member 43 is protruded from the gap 53*c* of the upper surface ring 53 in order that laser BL can be appropriately reflected to the reflecting ring 52.

In the cover 54 having a configuration as described above, the lateral circumferential portion 54*a* has a shape corresponding to the outer circumferential surface of the base ring 51, and an end portion of the lateral circumferential portion 54*a* is abutted against the step 51*b*, so that the cover 54 is engaged with the base ring 51 so as to cover the upper surface ring 53. Any appropriate material such as a metal or a resin may be used for the cover 54 as long as the material can shield light emitted from the laser light source 10 and the upper surface ring 53.

As shown in FIGS. 3 and 4, the reflector 40 changes a direction of the optical path of laser light BL so that the laser light BL transmitted from the laser light source 10 through the cylindrical body 20 can be propagated along the inner circumferential surface (i.e., light reflecting surface 52*a*) of the ring assembly 50, so that the reflector splits and reflects laser light BL. The reflector 40 is supported on the ring assembly 50 via the support member 43 disposed therebetween, and is disposed so as to face the optical path of laser light BL from the cylindrical body 20. The reflector 40 includes a first reflecting surface 41 and a second reflecting surface 42 which form a V shape with a predetermined angle in a cross-sectional view. In the reflector 40, a corner of the V-shaped cross-section formed by the first reflecting surface 41 and the second reflecting surface 42 and facing the optical path of laser light BL is located at the central axis of laser light BL, and laser light BL can be split into two beams into a first side and a second side. The first reflecting surface 41 and the second reflecting surface 42 of the reflector 40 respectively has a sufficiently large size with respect to the beam diameter of laser light BL. For example, the first reflecting surface 41 and the second reflecting surface 42 may be formed using two reflecting mirrors, or using a prism obtained by providing two triangular prisms or conical prisms and fitting the bottom surfaces of the cones to each other. The position of the reflector 40 corresponds to a first end or a second end of the propagation optical path at the inner circumferential surface of the ring assembly 50 in the circumferential direction.

Figure 7A:
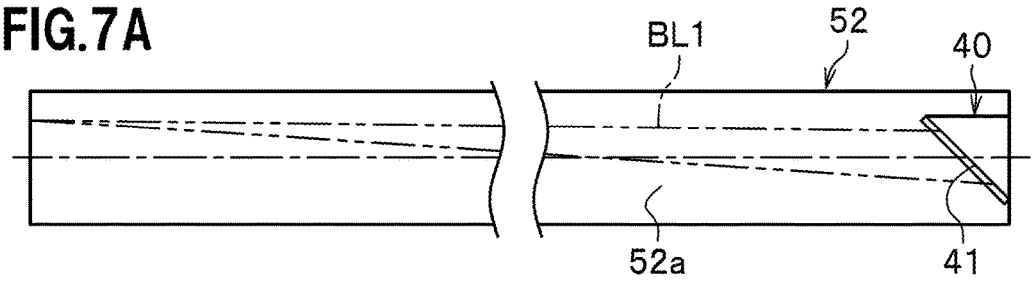
FIG. 7A is a schematic view schematically showing a direction in which laser light is propagated from a first reflecting surface of the reflector to a first side in the circumferential direction in the illumination device according to one embodiment of the present invention.
Figure 7B:
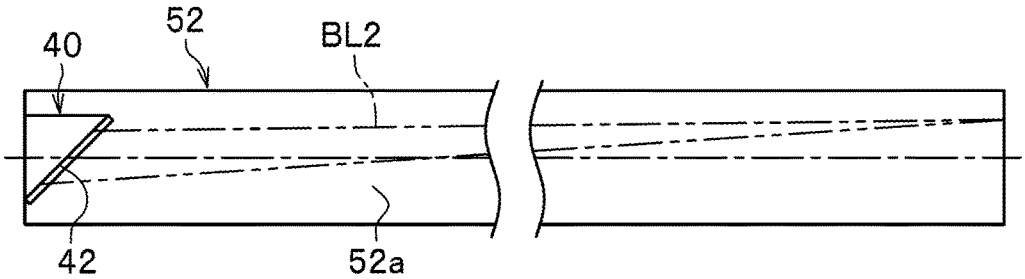
FIG. 7B is a schematic view schematically showing a direction in which laser light is propagated from a second reflecting surface of the reflector to a second side in the circumferential direction in the illumination device according to one embodiment of the present invention.
Figure 9A:
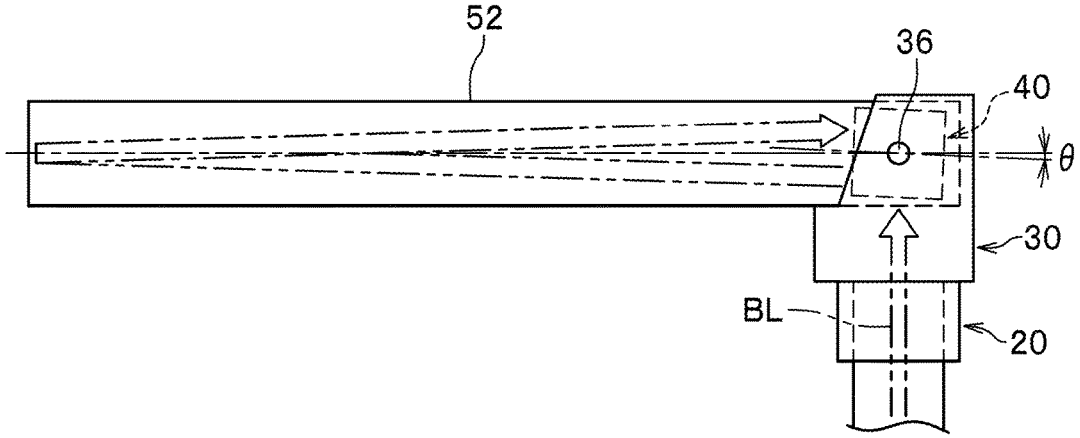
FIG. 9A is a schematic diagram showing a direction of propagation of laser light in the ring assembly disposed to be parallel to an installation surface in the illumination device according to one embodiment of the present invention.

As shown in FIGS. 7A and 7B, the reflector 40 is installed at an angle that allows laser light BL to be emitted such that the central beam optical axis of laser light BL reflected by the first reflecting surface 41 or the second reflecting surface 42 is located at an upper side with respect to the center of the light reflecting surface 52*a* in the width direction, at a first or a second end of the propagation optical path in the circumferential direction. More specifically, the reflector 40 is installed at an inclination angle θ that allows the inner circumferential surface side of the ring assembly 50 is inclined with respect to the horizontal plane as shown in FIGS. 7A, 7B and 9A. The inclination angle θ is in accordance with the width and length of the light reflecting surface 52*a*, and is in a range of, for example, 0.05 to 1 degrees. The inclination angle θ is preferably represented by ArcTan (x/A) where A is a length of the light reflecting surface 52*a* in the circumferential direction, and x is a beam width of laser light reflected at the light reflecting surface.

Figure 6:
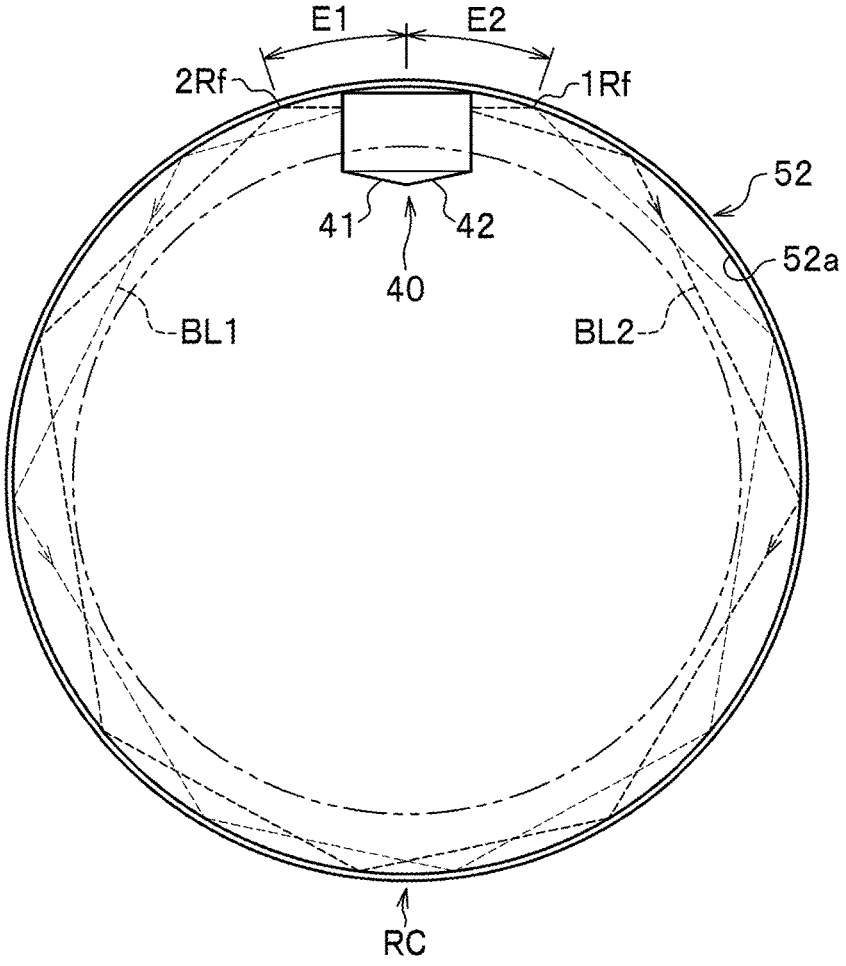
FIG. 6 is an explanatory diagram schematically showing a state in which light is reflected and propagated in the ring assembly of the illumination device according to one embodiment of the present invention.

Each of the expressions "a first end of the light reflecting surface 52*a* in the circumferential direction" and "a second end of the light reflecting surface 52*a* in the circumferential direction" refers to, in the case where the first reflecting surface 41 of the reflector 40 is a starting position, a portion of the light reflecting surface 52*a* that corresponds to the second reflecting surface 42, and in the case where the second reflecting surface 41 is a starting position, a portion of the light reflecting surface 52*a* that corresponds to the first reflecting surface 41. However, "the first end of the light reflecting surface 52*a* in the circumferential direction" and "the second end of the light reflecting surface 52*a* in the circumferential direction" as described in the present specification are not strictly specified, and may refer to, for example, a predetermined region E1 or E2, each of which including a portion of the light reflecting surface 52*a* that corresponds to the first reflecting surface 41 or the second reflecting surface 42, respectively, as shown in FIG. 6. The region E1 extends between a position on the light reflecting surface 52 which corresponds to the first reflecting surface 41 and a position 2Rf on the light reflecting surface 52, at which laser light BL is reflected last. The region E2 extends between a position on the light reflecting surface 52 which corresponds to the second reflecting surface 42 and a position 1Rf on the light reflecting surface 52 at which laser light BL is reflected last. Laser light BL is preferably reflected and propagated on the light reflecting surface 52*a* over a longer distance.

Further, it is preferable that the first end of the light reflecting surface 52*a* in the circumferential direction and the second end of the light reflecting surface 52*a* in the circumferential direction are located farther from the starting position.

The support member 43 supports the reflector 40, and attaches the reflector 40 to the ring assembly 50. The support member 43 is installed on the ring assembly 50 side so that the reflector 40 protrudes from the gap 53*c* formed in the upper surface ring 53 of the later-described ring assembly 50 as described below. The support member 43 includes a fan-shaped substantially flat plate 44, and positioning protrusion portions 45 protruding from a surface of the flat plate portion 44. The positioning protrusion portions 45 are located at four positions, that is, at the front, rear, left, and right side of the reflector 40. In the reflector 40, at least two of the positioning protrusion portions 45 are detachably engaged with the flat plate 44 using a screw etc., which allows the inclination angle θ and the position of the reflector 40 to be finely adjusted. The support member 43 is fixed to the base ring 51 of the ring assembly 50 described below using a screw etc.

The reflector 40 supported by the support member 43 and installed on the ring assembly 50 reflects laser light BL from the laser light source 10 such that the laser light BL is split into two beams by the first reflecting surface 41 and the second reflecting surface 42, and a first and a second of the two beams are propagated along the inner circumferential surface of the ring assembly 50 (i.e., light reflecting surface 52*a* of the reflecting ring 52). The first reflecting surface 41 and the second reflecting surface 42 may be disposed so as to reflect laser light BL such that, at an end portion of the light reflecting surface 52*a*, the optical axis that is the central axis of reflected laser light BL is located at an upper side (i.e., at a fluorescent surface 53*a* side) with respect to the center of the light reflecting surface 52*a* in the width direction thereof than a position of the center line of the reflecting ring 52 with respect to the center of the light reflecting surface 52*a* in the width direction thereof (see FIGS. 7A and 7B).

The optical axis is preferably located closer to the upper side. With the first reflecting surface 41 and the second reflecting surface 42 arranged as described above, a portion of laser light BL can be easily wavelength-converted by the upper surface ring 53 having the fluorescent surface 53*a*, so that a larger amount of illumination light can be supplied.

The illumination device 1 having the configuration described above has the following effects.

Figure 8:
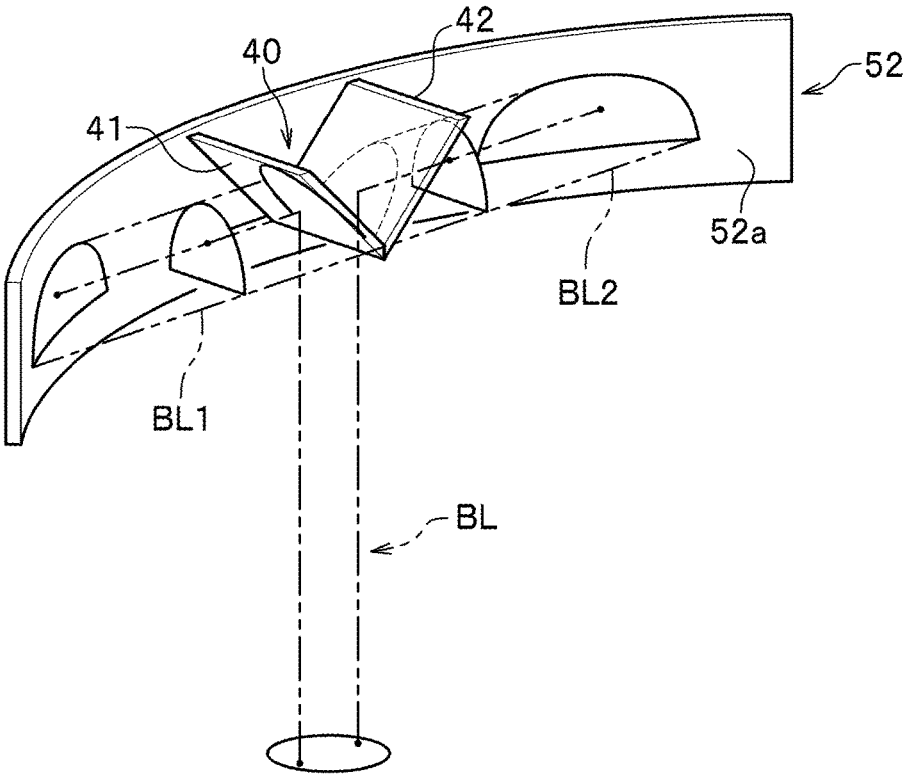
FIG. 8 is a perspective view schematically showing a state of laser light reflected by the first reflecting surface and the second reflecting surface in the reflector of the illumination device according to one embodiment of the present invention.

In the illumination device 1, laser light BL is emitted from the laser light source 10, and the laser light BL is then transmitted toward the reflector 40 through the cylindrical body 20. As shown in FIGS. 6 and 8, the laser light BL transmitted to the reflector 40 is reflected by the first reflecting surface 41 and the second reflecting surface 42, and split into two beams directed in different directions: a first is light BL1 directed from a first side in the circumferential direction toward a second side in the circumferential direction of the reflecting ring 52, and a second is light BL2 directed toward the first side in the circumferential direction from the second side in the circumferential direction of the reflecting ring 52. Light BL1 and light BL2 obtained by splitting laser light BL are partially incident on the fluorescent surface 53*a* of the upper surface ring 53 to be wavelength-converted into white light during reflection and propagation at the light reflecting surface 52*a* of the reflecting ring 52. Accordingly, in the illumination device 1, light BL1 and light BL2 obtained by splitting laser light BL are reflected and propagated at the light reflecting surface 52*a* of the reflecting ring 52, and thus the entire upper surface ring 53 emits light, so that ring-shaped illumination light can be obtained.

Figure 9B:
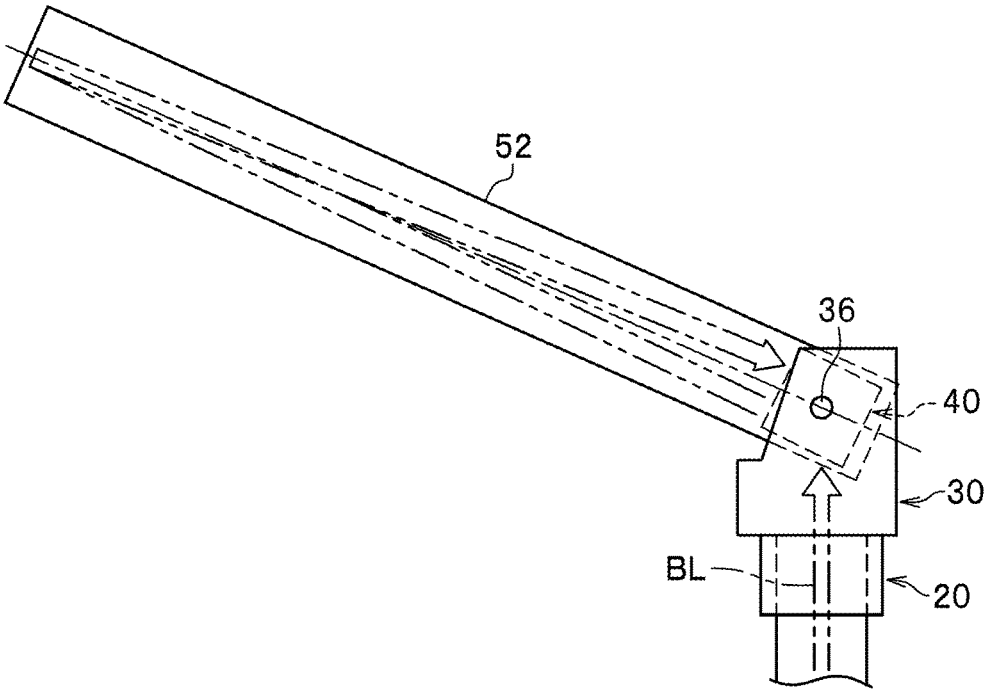
FIG. 9B is a schematic diagram showing a direction of propagation of laser light in the ring assembly disposed to be inclined with respect to the installation surface in the illumination device according to one embodiment of the present invention.

In the illumination device 1, the angle of the ring assembly 50 can be adjusted via the rotary support shaft portion 36 as shown in FIGS. 9A and 9B, so that an emission direction of the illumination light can be easily changed. In the illumination device 1, even in the case where the support angle of the ring assembly 50 is adjusted to be changed, a rotation center of the reflector 40 corresponds to a portion of the reflector 40 to which laser light BL is emitted when laser light BL is transmitted from the laser light source 10 to the reflector 40. Accordingly, even in the case where the angle of the ring assembly 50 is changed to a predetermined angle and thus a position of the ring assembly 50 is changed from the original position, laser light BL is transmitted to the first reflecting surface 41 and the second reflecting surface 42 of the reflector 40, and is propagated along the light reflecting surface 52*a* of the reflecting ring 52.

In the illumination device 1, the first reflecting surface 41 and the second reflecting surface 42 split laser light BL into two beams, and propagate these beams on the light reflecting surface 52*a* in mutually different directions, and thus light having a uniform luminous intensity can be extracted as illumination light using a device which is inexpensive, and has a small size and a simple configuration. The ring assembly 50 is formed as a unit including the base ring 51, the reflecting ring 52, the upper surface ring 53 and the cover 54, so that the illumination device 1 can be efficiently and inexpensively produce. In the illumination device 1, the laser light source 10 includes the collimating lens 6 to adjust the cross-sectional shape of laser light BL, and thus the light beam reflected at the reflector 40 can be easily controlled, so that more uniform light can be obtained.

In the illumination device 1, with the reflector 40 made of a prism, the number of components can be reduced to simplify the configuration.

Further, with the cover (light shielding member) 54, leak of laser light BL from the laser light source 10, the reflecting ring 52 or the upper surface ring 53 to outside can be prevented, so that the illumination device 1 has sufficient safety.

The illumination device 1 is an illumination device with good practicability in view of that the housing 11 including the laser light source 10 can be installed at a lower side such as on the ground or a desk, the housing 11 supports the ring assembly 50 and reflector 40 at an upper side via the cylindrical body 20, and the ground, desk or the like on the lower side can be illuminated by the ring assembly 50 and reflector 40 provided on the upper side.

The illumination device 1 described above may have the following configuration.

In the illumination device 1, the ring assembly 50 may have the light reflecting surface 52*a* or upper surface ring 53 formed directly on the base ring 51. Irrespective of whether the light reflecting surface 52*a* is formed as a body separated from the base ring 51, or formed directly on the base ring 51, for example, aluminum, an aluminum alloy, tin, a tin alloy, silver, a silver alloy, zinc, a zinc alloy, magnesium, a magnesium alloy, platinum, a platinum alloy or the like can be used for a material of the light reflecting surface 52*a*.

In the illumination device 1, the support member 43 for attaching the reflector 40 may be supported on the inner circumferential surface of the base ring 51. In this configuration, it is preferable that a portion of the base ring 51 is recessed so that that the support member 43 can be attached to the recessed portion. In the illumination device 1, the size, shape or attachment position of the support member 43, which supports the reflector 40, can be appropriately selected as long as the support portion can be disposed on the ring assembly 50.

In the above description, the reflector 40 is set via the support member 43, but the reflector 40 may be provided directly on the ring assembly 50 via an adhesive etc. The ring assembly 50, on which the reflector 40 is provided directly via an adhesive etc., is disposed on the inner circumferential surface of the cover 54 or base ring 51.

Further, in the illumination device 1, the cover 54 may not be disposed, and alternatively, the upper surface ring 53 may be closed at the center to serve also as a cover.

In the above description, the illumination device 1 has a configuration in which the ring assembly 50 is configured to be operated to form a predetermined angle with respect to the holding body 30, but the ring assembly 50 may be fixed at a predetermined angle. The illumination device 1 may have a configuration in which the ring assembly 50 is fixed directly to the second interposition pipe 23 of the cylindrical body 20 without the holding body 30 disposed therebetween.

In the reflector 40, the angles and directions of the first reflecting surface 41 and the second reflecting surface 42 may be selected so that the optical axis that is the central axis of laser light BL at a position on the light reflecting surface 52*a* beyond the center of the light reflecting surface in the circumferential direction (i.e., beyond a position corresponding to the semicircle) and corresponding to the first reflecting surface 41 or the second reflecting surface 42 is located at fluorescent surface 53*a* side of the light reflecting surface 52*a* beyond the center of the light reflecting surface 52*a* in the width direction. With the inclination angle θ of the reflector 40 that allows the optical axis of laser light BL to be located between the center of the light reflecting surface 52*a* in the circumferential direction (i.e., beyond a position corresponding to the semicircle) and an end thereof in the circumferential direction, laser light BL can be reflected and propagated over the entire circumference of the light reflecting surface 52*a* in a state where a laser light BL from the first end side of the light reflecting surface 52*a* in the circumferential direction and a laser light BL from the second end side of the light reflecting surface 52*a* in the circumferential direction is in combination.

With the base ring 51 that has the predetermined length as described above in a region between the engaging protrusion portion 51*a* and the lower end of the base ring 51 and a region between the step portion 51*b* and the lower end of the base ring 51, a second fluorescent surface can be formed on the inner circumferential surface of the base ring 51 with the predetermined length, so that conversion efficiency of illumination light can be improved.

The reflector 40 may be formed by forming each of the first reflecting surface 41 and the second reflecting surface 42 to be a mirror surface, mirror-polishing a surface of a metal body, or bonding a sheet serving as a reflecting surface to a substrate.

For example, the fluorescent surface 53*a* may be formed on the same plane as the light reflecting surface 52*a*. In the case where the fluorescent surface 53*a* and the light reflecting surface 52*a* are disposed on the same plane, the reflector 40 may be installed without being inclined by an inclination angle θ so that the optical axis of laser light BL can correspond to the center of the light reflecting surface 52*a* in the width direction. In the case where the fluorescent surface 53*a* and the light reflecting surface 52*a* are on the same surface, disposing a transparent resin containing a fluorescent material is on the light reflecting surface 52*a* allows the fluorescent surface 53*a* to be disposed on the same plane as the light reflecting surface 52*a*.

Further, in the description of the ring assembly 50, the light reflecting surface 52*a* is a ring-shaped inner circumferential surface as one example, but the ring assembly 50 may alternatively have an elliptical inner circumferential surface, a C-shaped inner circumferential surface, or an inner circumferential surface 80% or more of which has an arc shape, as long as the ring assembly 50 can reflect and propagate light in the circumferential direction.

The pedestal 31 may be made of any appropriate material such as a resin or a metal.

In the laser light source 10, a connection code for establishing connection to an external power source is installed in the housing 11, or a battery is stored in the laser light source 10, which allows for controlling lighting/extinguishing of illumination by on/off switch or a remote control switch of a power source.

DENOTATION OF REFERENCE NUMERALS

1 illumination device
2 laser diode
3 stem columnar body
4 substrate
5 slit hole
6 collimating lens
7 heat sink
10 laser light source
11 housing
20 cylindrical body
21 hollow pipe
22 first interposition pipe
23 second interposition pipe
30 holding body
31 pedestal
32 main body portion
33 upward-extending portion
34 through-hole
35 shaft hole
36 rotary support shaft portion
40 reflector
41 first reflecting surface
42 second reflecting surface
43 support portion
44 flat plate
45 positioning protrusion portion
50 ring assembly
51 base ring
51*a* engaging protrusion portion
51*b* step portion
51*c* inner circumferential surface
52 reflecting ring
52*a* light reflecting surface
52*b* outer circumferential surface
53 upper surface ring
53*a* fluorescent surface
53*b* abutting end portion
53*c* gap
54 cover (light shielding member)
54*a* lateral circumferential portion
54*b* top plate inner circumferential surface

54*c* attachment recess
54*d* central top plate
BL laser light (light beam)

What is claimed is:

1. An illumination device comprising:
a laser light source;
a cylindrical body disposed such that light emitted from the laser light source enters the cylindrical body at a first end portion side of the cylindrical body and passes through the cylindrical body;
a reflector disposed so as to reflect light passing through the cylindrical body; and
a ring assembly comprising a ring-shaped inner circumferential surface configured to reflect and propagate light from the reflector,
wherein the reflector comprises:
a first reflecting surface configured to reflect a first portion of light emitted from the laser light source such that the first portion of light is propagated from a first side of the inner circumferential surface in a circumferential direction to a second side of the inner circumferential surface in the circumferential direction, and
a second reflecting surface configured to reflect a second portion of light emitted from the laser light source such that the second portion of light is propagated from the second side of the inner circumferential surface in the circumferential direction to the first side of the inner circumferential surface in the circumferential direction, and
wherein the ring assembly further comprises a fluorescent surface adapted to emit fluorescence by light reflected and propagated at the inner circumferential surface.

2. The illumination device according to claim 1, wherein:
the ring assembly further comprises:
a base ring comprising the inner circumferential surface, and
an upper surface ring disposed along the inner circumferential surface and comprising the fluorescent surface, and
the inner circumferential surface and the fluorescent surface are disposed adjacent to each other.

3. The illumination device according to claim 1, wherein the reflector is a prism.

4. The illumination device according to claim 1, wherein the laser light source comprises a collimating lens configured such that an optical path of laser light emitted from the laser light source passes therethrough, the collimating lens being configured to convert the laser light into parallel light.

5. The illumination device according to claim 1, further comprising:
a holding body that holds the ring assembly on a second end portion side of the cylindrical body,
wherein the holding body comprises:
a pedestal connected to the second end portion side of the cylindrical body, and
a rotary support shaft portion that supports the ring assembly such that an installation angle of the ring assembly is changeable,
wherein the pedestal comprises:
a main body portion having an opening configured to allow light that has passed through the cylindrical body to pass through the opening toward the reflector, and
upward-extending portions that hold the rotary support shaft portion at both sides of the main body portion, and
wherein the rotary support shaft portion is fixed to the ring assembly and supported by the upward-extending portions in a rotatable manner.

6. The illumination device according to claim 5, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

7. The illumination device according to claim 5, wherein:
the ring assembly further comprises:
a base ring comprising the inner circumferential surface, and
an upper surface ring disposed along the inner circumferential surface and comprising the fluorescent surface, and
the inner circumferential surface and the fluorescent surface are disposed adjacent to each other.

8. The illumination device according to claim 7, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

9. The illumination device according to claim 5, wherein the reflector is a prism.

10. The illumination device according to claim 9, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

11. The illumination device according to claim 5, wherein the laser light source comprises a collimating lens configured such that an optical path of laser light emitted from the laser light source passes therethrough, the collimating lens being configured to convert the laser light into parallel light.

12. The illumination device according to claim 11, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

13. The illumination device according to claim 5, wherein the ring assembly further includes a light shielding member on a side away from the laser light source, the light shielding member shielding light from the laser light source and the fluorescence.

14. The illumination device according to claim 13, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

15. The illumination device according to claim 13, further comprising a support member disposed on the light shielding member and supporting the reflector.

16. The illumination device according to claim 15, wherein the rotary support shaft portion is supported by the upward-extending portions such that a static friction coefficient between the rotary support shaft portion and the upward-extending portions is greater than a dynamic friction coefficient between the rotary support shaft portion and the upward-extending portions.

17. The illumination device according to claim 1, wherein the ring assembly further includes a light shielding member on a side away from the laser light source, the light shielding member shielding light from the laser light source and the fluorescence.

18. The illumination device according to claim 17, further comprising a support member disposed on the light shielding member and supporting the reflector.

* * * * *